United States Patent [19]

Milam

[11] 4,366,861

[45] Jan. 4, 1983

[54] DOWNHOLE GAS SEPARATOR

[76] Inventor: Jay K. Milam, 3005 N. Park, Claremore, Okla. 74017

[21] Appl. No.: 222,348

[22] Filed: Jan. 5, 1981

[51] Int. Cl.[3] ..... E21B 43/38

[52] U.S. Cl. ..... 166/105.5; 166/243

[58] Field of Search ..... 166/105.5, 105.6, 243

[56] References Cited

U.S. PATENT DOCUMENTS

| | | | |
|---|---|---|---|
| 1,554,842 | 9/1925 | Coulter | 166/105.5 |
| 1,655,817 | 1/1928 | Marsh | 166/105.5 |
| 1,682,114 | 8/1928 | Carlson | 166/105.5 |

*Primary Examiner*—Stephen J. Novosad
*Assistant Examiner*—Joseph Falk
*Attorney, Agent, or Firm*—Head, Johnson & Stevenson

[57] ABSTRACT

A downhole gas separator for use with a downhole pump in a producing well bore, the gas separator being secured to the lower end of the pump and generally comprises inner and outer concentrically arranged tubes extending downwardly within the well tubing, the first tube being provided with a plurality of perforations in the sidewalls thereof adjacent the upper portion thereof, and the second tube being provided with a plurality of perforations in the sidewalls thereof adjacent the lower portion thereof. The well fluid contained in the well bore is drawn into the well casing and travels through a long, torturous upward and downward path through the well tubing and gas separator and to the surface of the well bore, with substantially all of the gas being separated from the heavier components of the fluid during the travel. The gas separator is preferably of an overall length at least approximately equal to the length of a single well tubing joint to provide sufficient length of travel for the well fluid to remove substantially all of the entrained gas and to filter substantially all debris from the fluid stream.

4 Claims, 2 Drawing Figures

DOWNHOLE GAS SEPARATOR

BACKGROUND OF THE INVENTION

1. Field of the Invention

The present invention relates to improvements in a downhole gas separator and, more particularly, to a downhole gas separator adapted to be secured to the lower end of a downhole rod pump in a producing oil well bore, or the like.

2. Description of the Prior Art

When an oil well is initially completed, the downhole pressure may be sufficient to force the well fluid upwardly through the well tubing string to the surface of the well bore. In some instances, however, this downhole pressure is dissipated, and some form of artificial lift is required to elevate the well fluid in the well bore. The most common form of artificial lift in present day use is a downhole rod pump, which is suspended within the tubing string and operably connected to a reciprocating surface unit by a string of sucker rods. In wells which produce gas along with oil, there is a tendency for the gas to flow upwardly into the pump, which may result in a "gas lock" in the pump whereby no fluid is pumped or elevated in the well bore even though the surface unit is continuing to reciprocate. Also, gas in the pump decreases the volume of oil transported to the surface, which decreases the overall efficiency of the pumping unit and reduces oil production.

In order to prevent this entrained gas from interfering with the pumping of the oil, various downhole gas separators have been developed to remove the gas from the well fluid prior to the introduction of the fluid into the pump. A typical present day gas separator comprises a perforated closed end tubing, which is attached to the lower portion of the tubing string disposed within the well casing. The gas separator is perforated in the proximity of the lowermost portion thereof and below the level of the usual perforations of the well casing. As the well fluid flows inwardly through the perforations in the casing, the gas, being lighter than the remaining components of the fluid, tends to travel upwardly in the annulus between the tubing and the casing while the remaining fluid travels downwardly through the perforations in the gas separator and then upwardly through the well tubing to the rod pump. These gas separators have two main disadvantages. First, the gas separators usually remove only a portion of the entrained gas within the well fluid and a substantial portion of the gas is carried downwardly with the well fluid and up into the tubing and the pump. Secondly, these gas separators are normally attached to the well tubing string. During a well work over operation the following steps are involved in removing and replacing the gas separator installed on the tubing string: set up the work rig, pull the pump and rods, take the tubing out of tension, release the tubing anchor, nipple down the tree, pull the tubing, remove the anchor, remove the gas separator, install a new gas separator, install a new or reconditioned anchor, run the tubing, set the tubing anchor, pull tension on the anchor, nipple up the tree, run the rods and the replacement pump, and take down the work over rig. This whole operation normally takes twenty-four hours or more, which is not only extremely expensive, but also greatly increases the possibility of damage to the well structure. The disadvantages of these present day gas separators will be readily apparent.

SUMMARY OF THE INVENTION

The present invention contemplates a novel gas separator particularly designed and constructed for overcoming the foregoing disadvantages. The novel gas separator comprises an outer tube which is attached to the bottom portion of a suitable downhole rod pump and an inner tube connected to the downhole rod pump and concentrically arranged within the outer tube. The outer tube has perforations adjacent the upper portion thereof, and has a lower removable clean out plug. The inner tube has a closed lower end and has perforations adjacent the lower end thereof. An important feature of the present invention is that the length of the gas separator should preferably be at least as great as one tubing joint length to achieve the greatest practical gas removal efficiency. Generally, the length of the gas separator should be at least fifteen feet.

In operation, the well fluid flows through the perforations in the well casing with the gaseous components thereof tending to flow upwardly in the annulus between the tubing and the casing and the heavier components flowing downwardly until encountering perforations in the tubing or a perforated pump joint at the lowermost position of the well bore. The fluid then flows upwardly and through the perforations in the upper portion of the outer tube and then downwardly to the perforations in the inner tube, and then upwardly to the rod pump in the usual manner for elevation to the surface of the well. At each down turn of the well fluid, the suspended or entrained gas tends to flow upwardly, thereby being removed or separated from the down flowing well fluid stream. This circuitous path over the great length of the novel gas separator greatly increases the amount of gas separated from the fluid stream prior to entry of the well fluid into the pump, thereby increasing the pumping efficiency. Another important feature of the present invention is that the gas separator is attached directly to the rod pump rather than the well tubing, thereby greatly decreasing the cost of replacement. For example, the following steps are required for removing a gas separator of the present invention: set up the work over rig, pull the rods and the pump, replace the pump and the gas separator, run the pump and the rods back through the well bore, and take down the work over rig. The total time for the above operation is normally approximately eight hours, which is one-third the time required for removal and replacement of the usual presently available downhole gas separators. Time and expense are saved as well as a reduction of inadvertant damage of any of the well structure and equipment during the pulling operations.

DETAILED DESCRIPTION OF THE PREFERRED EMBODIMENTS

Figure 1A:
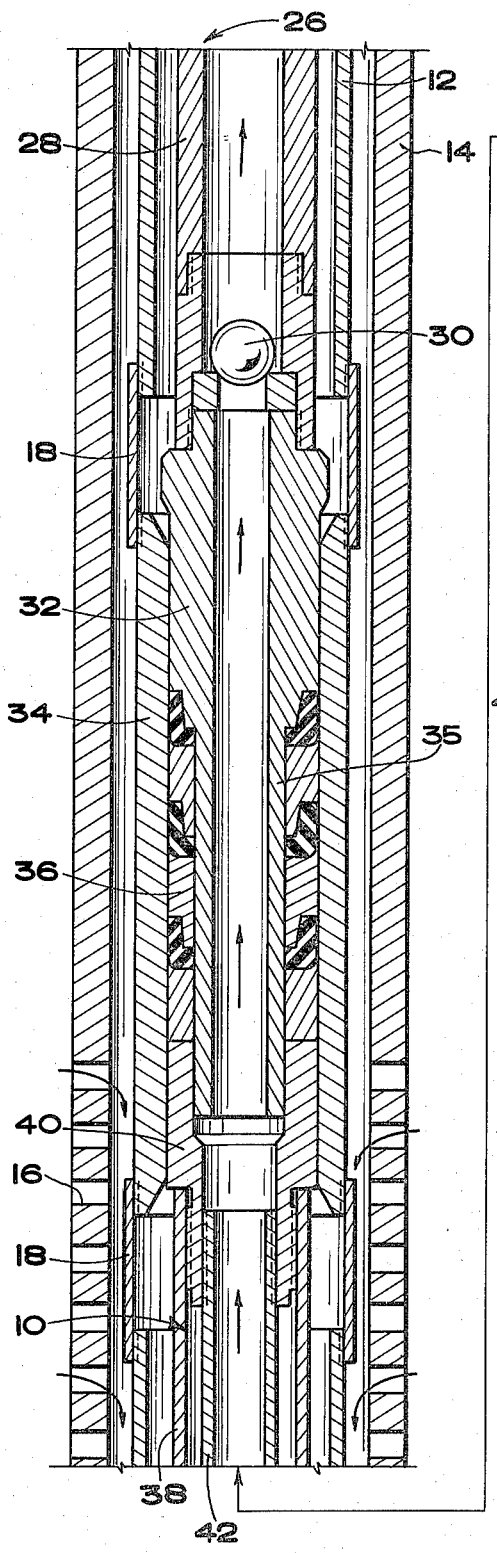
FIGS. 1A and 1B comprise a broken sectional elevational view of a gas separator embodying the invention and shown attached to the lower end of a down-hole rod pump in a well bore.
Figure 1A:
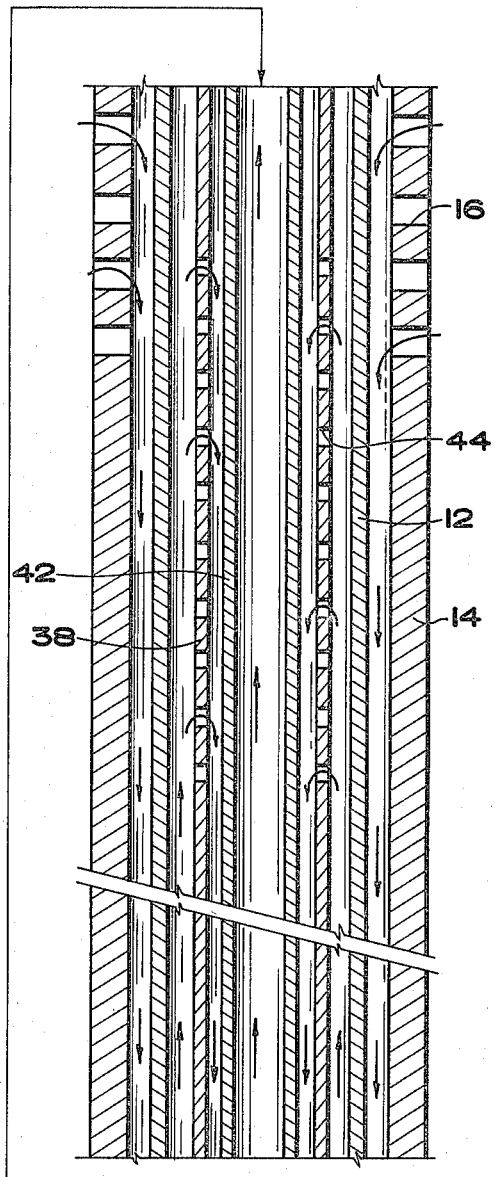
Figure 1B:
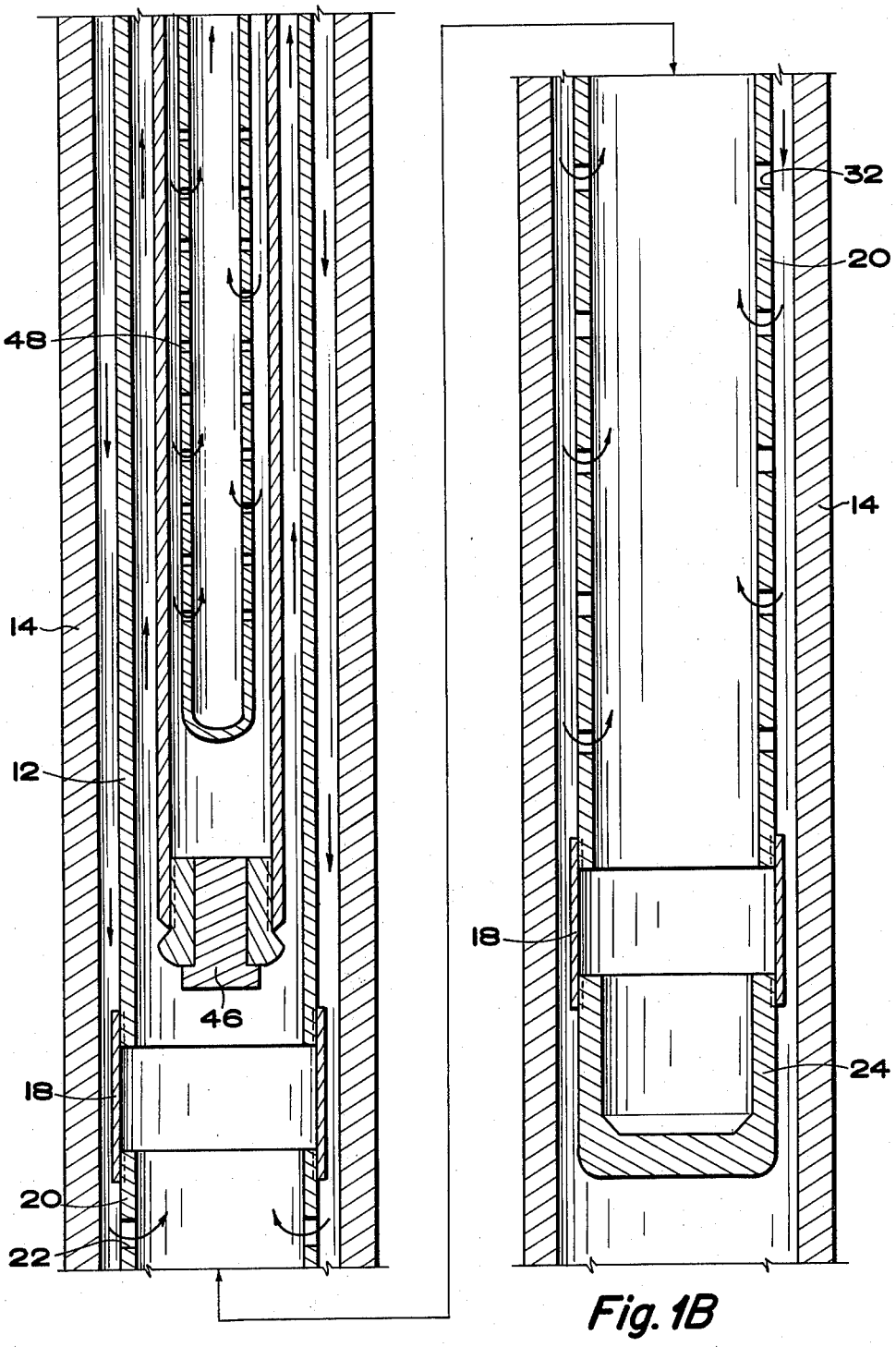

Referring to the drawings in detail, reference character 10 generally indicates a downhole gas separator for use in a producing oil well, or the like. As shown herein, a plurality of end-to-end well tubing joints or a well tubing string 12 is anchored within a well casing 14 in any suitable manner, as is well known. The casing 14 is provided with a plurality of spaced perforations 16 adjacent the oil producing zone (not shown) of the well bore (not shown). The well tubing joints 12 are connected together by suitable tubing couplings 18. As particularly shown in FIG. 1B, a perforated pup joint 20 having spaced perforations 22 provided in the sidewall thereof is connected to the lower portion of the well tubing string 12 and an end cap or bull plug 24 is connected to the lower end of the pup joint 20 for closing thereof. If desired, the pup joint 20 and bull plug 24 may be eliminated and any other suitable form of completion apparatus may be installed in lieu thereof.

In the installation shown herein, a downhole rod pump 26 having a pump barrel 28 and a lower standing valve or closed cage 30 is concentrically disposed within the well tubing string 12. A seating mandrel 32 of substantially cylindrical configuration is connected to the lower end of the valve 30 and the interior of the mandrel 32 is in communication with the interior of the pump barrel 28 through the valve 30. The mandrel 32 extends into and through a suitable seating nipple 34 which is interposed in the tubing string 12, as is well known. The mandrel 32 is provided with a reduced diameter stem member 35 at the lower end thereof and a plurality of suitable nested seating cups 36 are interposed between the outer periphery of the stem 35 and the inner periphery of the nipple 34 for precluding leakage of fluid therebetween and for anchoring the pump 26 within the tubing string 12. Of course, the mandrel 32 may be withdrawn from the nipple 34 when it is necessary to remove the pump 26 and gas separator 10 from the well bore for any reason as will be hereinafter set forth in detail.

The gas separator 10 comprises an outer sleeve or tube 38 which is threadedly connected to the mandrel 32 through a suitable coupling 40. An inner tube 42 is concentrically disposed within the sleeve 38 and is threadedly secured to the mandrel 32 through the coupling 40. The outer tube 38 is provided with a plurality of spaced perforations 44 in the proximity of the upper portion thereof, and a removable clean out plug 46 is secured at the lower end thereof. The inner tube 42 is closed at the lower end thereof and is provided with a plurality of spaced perforations 48 disposed in the proximity of said closed end.

It has been found that a significant increase in pumping efficiency occurs by the elimination of additional gas from the well fluid through the use of the gas separator 10. The overall length of the gas separator 10 is important in the removal of the gas and may be particularly selected in accordance with the required applications. The length of the gas separator should be sufficient to eliminate the greatest amount of gas contained within the confines of the well bore. Very good gas separation results have been achieved when the gas separator 10 is of an overall length approximately equal to the length of a tubing joint of the well tubing string 12, and preferably at least fifteen feet. For example, a gas separator with an outer tube of approximately $1\frac{1}{2}''$ I.D. and an inner tube of $\frac{3}{4}''$ I.D. should preferably be approximately twenty one feet long. The lower perforations of the inner tube should be spaced longitudinally throughout a distance of approximately twelve inches, and the outer tube should be perforated at the top, with the uppermost perforations spaced approximately nine inches from the upper end thereof and extending through a longitudinal distance of approximately ten inches.

In operation, with the rod pump 26 seated properly in the seating nipple 34, and the gas separator 10 in place therebelow, the well fluid will enter the case 14 through the casing perforations 16. Part of the entrained gas in the flow stream will separate from the fluid and flow upwardly in the annulus between the casing 14 and the well tubing 12 and to the surface of the well where it may be vented off at the usual well tree (not shown). The remaining gas, still mixed with the heavier components of the fluid, flows downwardly in the annulus between the casing 14 and the tubing 12 and enters the well tubing string 12 through the perforated pup joint 20. The well fluid then fills the tubing 12 up to the seating nipple 34, at which point the fluid enters the outer tube 38 through the perforations 44. The heavier components of the fluid will once again flow to the perforations 48 in the inner tube 42. At this time, the pumping action of the rod pump 26 draws the fluid upwardly through the inner tube 42 and into the pump barrel 28 where it is then pumped to the surface of the well bore for use or storage, as is well known. At each down turn of the flow stream, gas separates from the oil or heavier components of the fluid and flows upwardly while the oil flows downwardly to enter through the perforations into the next stage of the separator. It has been found that the extreme distance the fluid stream must travel through its serpentine passage through the separator to the pump 26 knocks out a considerable portion of the entrained gas and thus, greatly decreases the amount of trapped gas within the oil thereby increasing the production of the well through increased efficiency of pumping.

In the event that the gas separator 10 becomes fouled through accumulation of silt, sand or other debris, the gas separator 10 may be easily removed by simply pulling the rod pump 26 from the well tubing string 12, thus eliminating the necessity of pulling the whole tubing string in order to remove and repair the gas separator. Once the separator is at the surface of the well bore, the clean out plug 36 may be removed therefrom and any trapped or embedded material may be removed therefrom. An added advantage of the gas separator 10 of the present invention is that it provides not only increased oil/gas separation, but also tends to remove additional suspended debris from the well fluid by the serpentine passage thereof before entry into the pump for elevation to the surface of the well bore.

Whereas the present invention has been described in particular relation to the drawings attached hereto, it should be understood that other and further modifications, apart from those shown or suggested herein may be made within the scope and spirit of this invention.

What is claimed is:

1. A downhole gas separator for a producing well bore having a perforated well casing, a perforated well tubing string anchored within the casing, and a downhole rod pump disposed within the tubing, said gas separator comprising;

an outer tube having one closed end and one open end, the open end being connected directly to the downhole rod pump and disposed entirely within said well tubing string, said outer tube having perforations provided in the sidewall thereof adjacent the upper portion thereof; and an inner tube concentrically disposed within said outer tube and having one closed end and one open end, the open end being secured directly to the downhole rod pump and in communication with the interior thereof, said inner tube having perforations provided in the sidewalls thereof adjacent the closed end thereof;

the inner and outer tubes cooperating with the well tubing to provide a circuitous elongated path of travel for well fluid to facilitate the separation of gaseous components from heavier components of the well fluid.

2. A gas separator as set forth in claim 1 wherein a clean out plug is removably secured to the closed end of the outer tube.

3. A gas separator as set forth in claim 1 wherein the overall length of the gas separator is at least equal to the length of one tubing joint of the well tubing string.

4. A gas separator as set forth in claim 3 wherein the overall length of the gas separator is at least fifteen feet.

* * * * *